US007661872B2

(12) United States Patent
Daniels et al.

(10) Patent No.: US 7,661,872 B2
(45) Date of Patent: Feb. 16, 2010

(54) APPARATUS FOR MIXING CHEMICALS WITH A LIQUID CARRIER

(76) Inventors: Ray Daniels, 2420 Butternut Ct., Dunedin, FL (US) 34698; Frank R. Daniels, 1360 Sago Ct., Dunedin, FL (US) 34698; Donald D. Dawkins, 1381 Admiral Woodson La., Clearwater, FL (US) 33755; Dale Mayberry, 5517 104th Way North, Seminole, FL (US) 33772

( * ) Notice: Subject to any disclaimer, the term of this patent is extended or adjusted under 35 U.S.C. 154(b) by 174 days.

(21) Appl. No.: 11/966,937

(22) Filed: Dec. 28, 2007

(65) Prior Publication Data

US 2009/0166449 A1 Jul. 2, 2009

(51) Int. Cl.
*B01F 5/04* (2006.01)

(52) U.S. Cl. ..... 366/173.1; 366/175.2

(58) Field of Classification Search ..... 366/162.1, 366/165.2, 173.1, 174.1, 181.5, 175.2, 160.1–160.3, 366/173.2, 167.1, 182.1, 182.2, 336–340; 137/888–896

See application file for complete search history.

(56) References Cited

U.S. PATENT DOCUMENTS 4,394,966 A * 7/1983 Snyder et al. ..... 239/127
4,702,891 A * 10/1987 Li et al. ..... 422/140
5,015,335 A * 5/1991 Green ..... 162/243
6,279,611 B2 * 8/2001 Uematsu et al. ..... 137/888
7,350,962 B2 * 4/2008 Kao et al. ..... 366/165.2
7,503,686 B2 * 3/2009 Tarmann et al. ..... 366/173.1

FOREIGN PATENT DOCUMENTS

DE 2803390 * 8/1978

* cited by examiner

*Primary Examiner*—Charles E Cooley
(74) *Attorney, Agent, or Firm*—Larson & Larson, P.A.; Frank Liebenow

(57) ABSTRACT

An application for a device for mixing chemicals into a flow of a liquid includes a mixing chamber and an input port at a first end of the mixing chamber. The input port has an input connection for accepting a flow of the liquid and a plurality of input port channels. The input port channels direct the flow of the liquid from the input connection to the mixing chamber at an angle with respect to an inner wall of the mixing chamber. Located close to the input port is a chemical input orifice for accepting a chemical into the mixing chamber. Located at a distal end of the mixing chamber is an output port that has an output connection for discharging a mixture of the liquid and the chemical and a plurality of output port channels. The output port channels direct a flow of the mixture angularly with respect to the inner wall of the mixing chamber to the output connection.

20 Claims, 5 Drawing Sheets

APPARATUS FOR MIXING CHEMICALS WITH A LIQUID CARRIER

FIELD OF THE INVENTION

This invention relates to the field of mixing chemicals and more particularly to a device for thoroughly mixing liquid chemicals with a liquid carrier such as water.

BACKGROUND OF THE INVENTION

For certain applications, various chemicals must be mixed with a carrier such as water before use or application. For example, when treating a lawn with fertilizer or insecticide, the concentrated liquid fertilizer or insecticide is mixed with water and the combined mixture is applied to the lawn with a spraying device. It is important that the liquid fertilizer or insecticide be mixed thoroughly with the water to prevent "burning" of the lawn or uneven application that might result in a striped lawn (darker where fertilizer is applied and lighter where no fertilizer is applied).

Previously, for lawn application, a stream of water drives a chemical pump. The device that converts the flow of water into a reciprocating motion to drive the chemical pump is known as a water motor. The water motor drives the chemical pump in relationship to the flow of water, thereby providing an amount of chemicals proportional to the flow of water. Previously, chemicals flowing from the output port of the chemical pump were simply injected into the water conduit at the exit of the water motor where the sprayer is attached. This simple method of mixing the liquid chemicals with water proved to be less than effective, delivering an uneven mix of chemicals and water due to the pulsed delivery of the liquid chemicals and a lack of turbulence in the delivery system.

What is needed is a device that will thoroughly mix liquid chemicals with a liquid carrier.

SUMMARY OF THE INVENTION

In one embodiment, a device for mixing chemicals into a flow of a liquid is disclosed including a mixing chamber and an input port at a first end of the mixing chamber. The input port has an input connection for accepting a flow of the liquid and a plurality of input port channels. The input port channels direct the flow of the liquid from the input connection to the mixing chamber at an angle with respect to an inner wall of the mixing chamber. Located close to the input port is a chemical input orifice for accepting a chemical into the mixing chamber. Located at a distal end of the mixing chamber is an output port that has an output connection for discharging a mixture of the liquid and the chemical and a plurality of output port channels. The output port channels direct a flow of the mixture angularly with respect to the inner wall of the mixing chamber to the output connection.

In another embodiment, a method of mixing chemicals into a flow of a liquid is disclosed including providing a turbulator mixing device comprising a mixing chamber with an input port at a first end. The input port has an input connection for accepting the flow of the liquid and a plurality of input port channels. The input port channels direct the flow of the liquid from the input connection to the mixing chamber at an angle with respect to an inner wall of the mixing chamber. Located close to the input port is a chemical input orifice for accepting a chemical into the mixing chamber. At a distal end of the mixing chamber is an output port that has an output connection for discharging a mixture of the liquid and the chemical and a plurality of output port channels. The output port channels direct the flow of the mixture angularly with respect to the inner wall of the mixing chamber and out the output connection. The method continues with providing a flow of the liquid into the input port; providing the chemical into the chemical input orifice; and directing the mixture from the output port onto a target of the application.

In another embodiment, a device for mixing chemicals into a flow of a liquid is disclosed including a mixing chamber and a device for accepting a flow of liquid into the mixing chamber that has a device for accepting the flow of the liquid (e.g., an input port) and devices for channeling the liquid into the mixing chamber directing the flow of the liquid at an angle with respect to an inner wall of the mixing chamber. Another device accepts a chemical into the mixing chamber. Another device situated at a distal end of the mixing chamber outputs a mixture of the liquid and the chemical from the mixing chamber and has a device for discharging the mixture and devices for channeling the mixture from the mixing chamber to the device for discharging the mixture angularly with respect to the inner wall of the mixing chamber.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
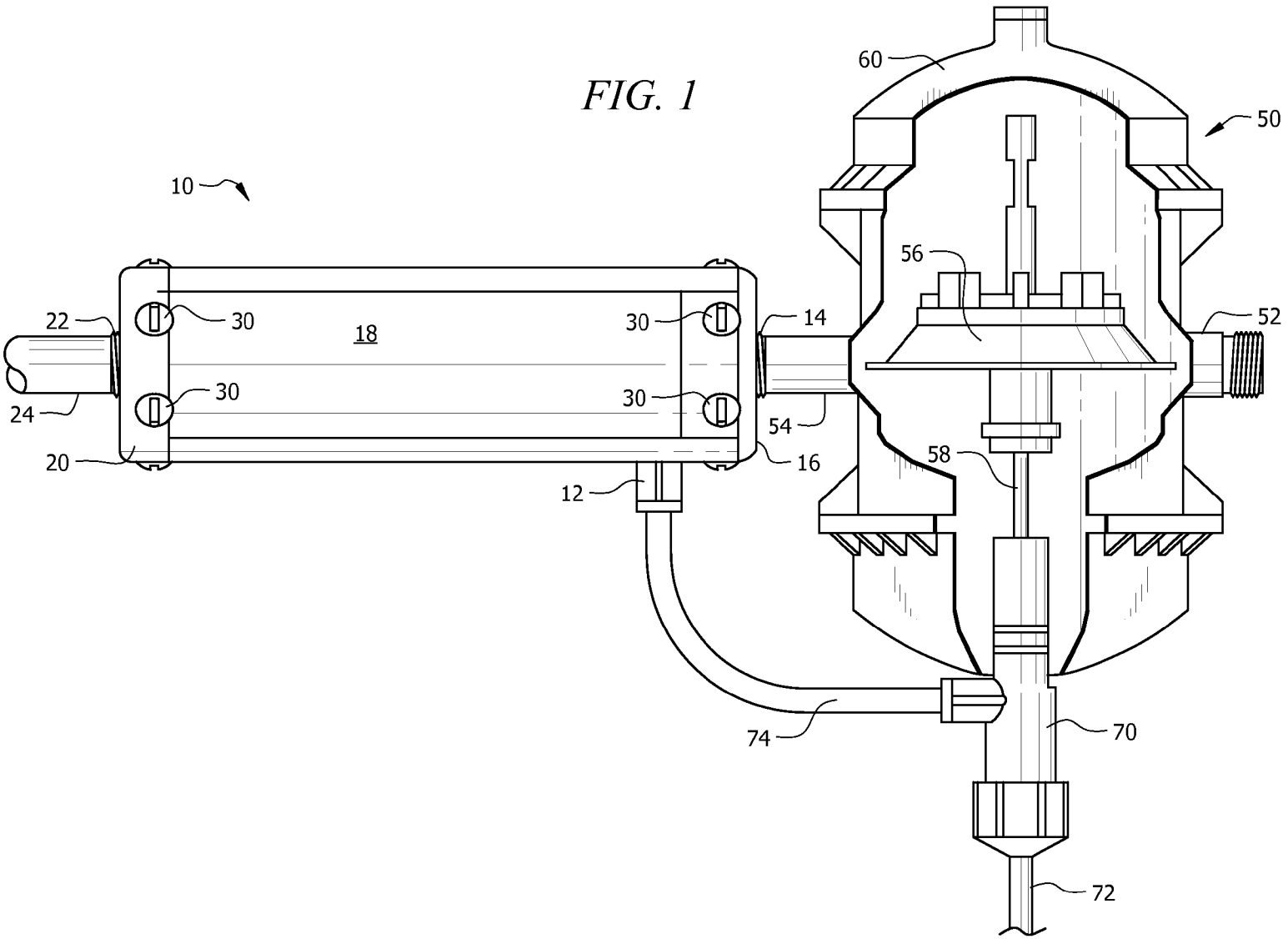
FIG. 1 illustrates a perspective view of a device of the present invention.

Reference will now be made in detail to the presently preferred embodiments of the invention, examples of which are illustrated in the accompanying drawings. Throughout the following detailed description, the same reference numerals refer to the same elements in all figures.

Throughout this description, an example of a lawn care application is used, mixing lawn chemicals proportionately with water before applying to a lawn. This is meant to be an example and the present invention is applicable to other situations where two liquids are mixed.

Referring to FIG. 1, a perspective view of a device of the present invention is shown. Although not part of the present invention, a water motor 50 is shown. For many lawn chemical companies, water is used to dilute lawn chemicals such as liquid fertilizer and liquid insecticide. The water is either stored in a tank on a truck or provided from a typical water tap. The water motor 50 accepts the water in an inlet pipe 52 and using a diaphram 56, uses the flow of water to invoke a reciprocal motion of a shaft 58. Note various water motors are possible. The shaft 58 is coupled to a pump 70 and the pump is fed with a supply of the lawn chemicals from an input line 72. The water motor 50 provides a proportional chemical supply, in that, as the user accesses a greater flow, the water motor 50 drives the chemical pump 70 at a greater speed, thereby adding a proportional amount of chemicals to the water.

Prior to the present invention, the output 74 of the chemical pump 70 was directly coupled to the output coupling 54 of the water motor 50. This configuration did not provide a thorough mix of lawn chemicals with the flowing water. for example, the lawn chemicals would stream on one side of the flow or, since the chemical pump 70 is a reciprocating pump, periods of chemical flow would be followed by periods of no chemical flow.

To rectify this situation and the lawn care problems that result, a turbulator mixing chamber 10 is provided. The turbulator mixing chamber 10 provides a chamber in which the chemicals are mixed thoroughly with the water by eddy currents. An input port 14 of the turbulator mixing chamber 10 interfaces with the source of water (in this case the output 54 of the water motor 50). The water travels through agitation tubes in the input end 16 of the turbulator mixing chamber 10, providing turbulent water within the main cylinder 18 where the lawn chemicals are inserted through a connection interface 12. As the water and the lawn chemicals travel down the main cylinder 18, they thoroughly mix. An output port 20, similar to the input port 16, is at a distal end of the main cylinder 18, further agitates the water and lawn chemicals and directs the water flow out an output orifice 22. It is anticipated that a conduit 24 such as a hose is attached to the output orifice 22.

In the preferred embodiment, the input port 16 and output port 20 are affixed to the main cylinder 18 with screws 30, although in other embodiments, the input port 16 and output port 20 are affixed to the main cylinder 18 with other means known in the industry including, but not limited to, rivets, welding, electrostatic welding, adhesive, pins, etc.

Figure 2:
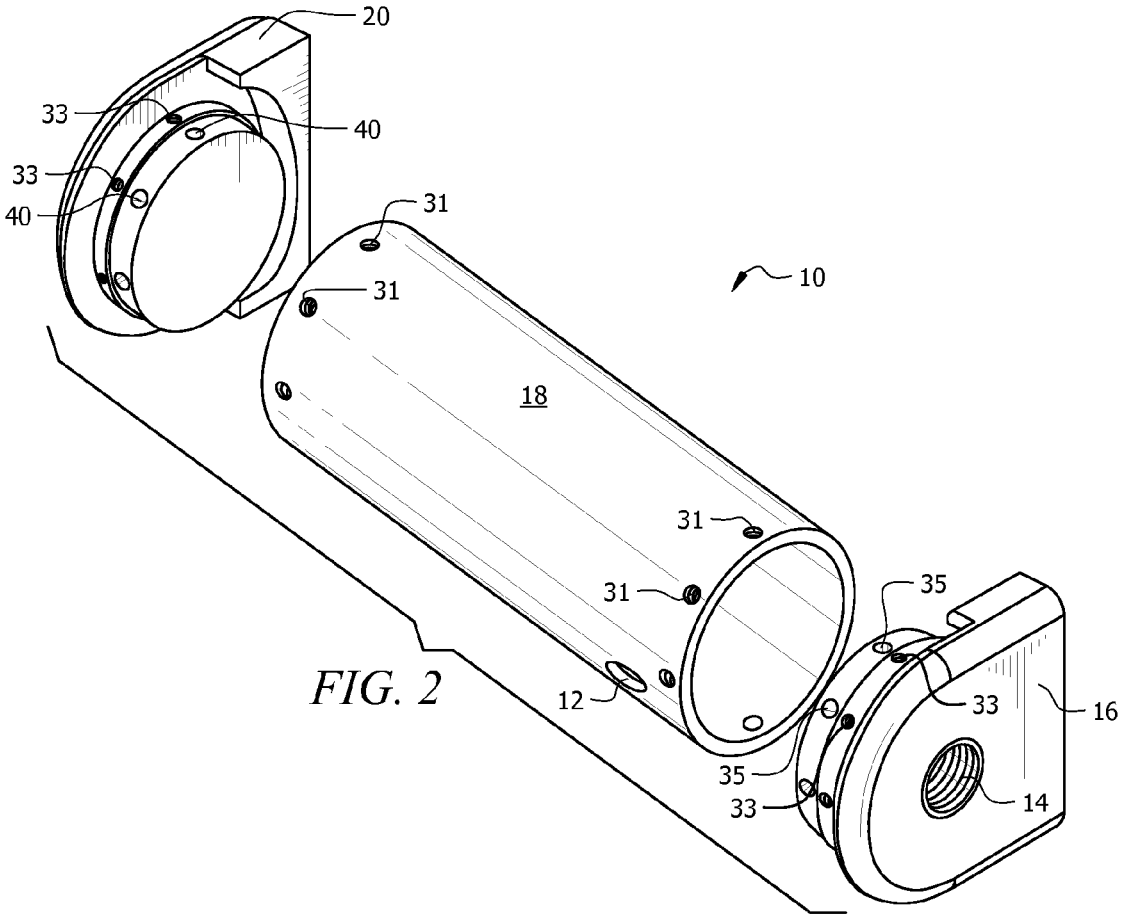
FIG. 2 illustrates an exploded view of the present invention.

Referring to FIG. 2, an exploded view of the present invention is shown. The main cylinder 18 is preferably a cylinder, though in other embodiments, it is of other cross-sectional shapes such as an octagonal cross section, etc. In some embodiments, the number of sides (e.g., 8 for octagon), match the number of channels 35/40, one per side.

The main cylinder 18 has a chemical input port 14 for accepting liquid chemicals into the main cylinder 18, for mixing with water (or other fluid). In general, the input port 16 and output port 20 are symmetrical, though this is not a requirement. Water flow enters the turbulator mixing chamber 10 through the input connection interface 14 of the input port 16. Within the input port 16, the water is directed through channels 35 to an outer circumference of the input port 16, where the input port 16 resides within the main cylinder 18. As will be seen, there is a clearance between the outer circumference of the input port 16 and the inner circumference of the main cylinder 18 in which the water flows from the input port 16 into the main cylinder 18, thereby causing turbulence and eddies. In some embodiments, the main cylinder 18 is affixed to the input port 16 by screws (not shown) passing through holes 31 in the main cylinder 18 and into holes 33 (preferably threaded or self-tapping) in the input port 16.

Water exiting the turbulator mixing chamber 10 passes through the output port 20 (similar to the input port 16). Within the output port 20, the water is directed over the outer circumference of the output port 20 and into channels 40. The channels 40 culminate in the output orifice 22 (not visible) for delivery outside of the turbulator mixing chamber 10. There is a clearance between the outer circumference of the output port 20 and the inner circumference of the main cylinder 18 in which the water flows from the main cylinder 18 to the output port 20 output interface 22, thereby further creating turbulence and eddies. In some embodiments, the main cylinder 18 is affixed to the output port 20 by screws (not shown) passing through holes 31 in the main cylinder 18 and into holes 33 (preferably threaded or self-tapping) in the output port 20.

Figure 3:
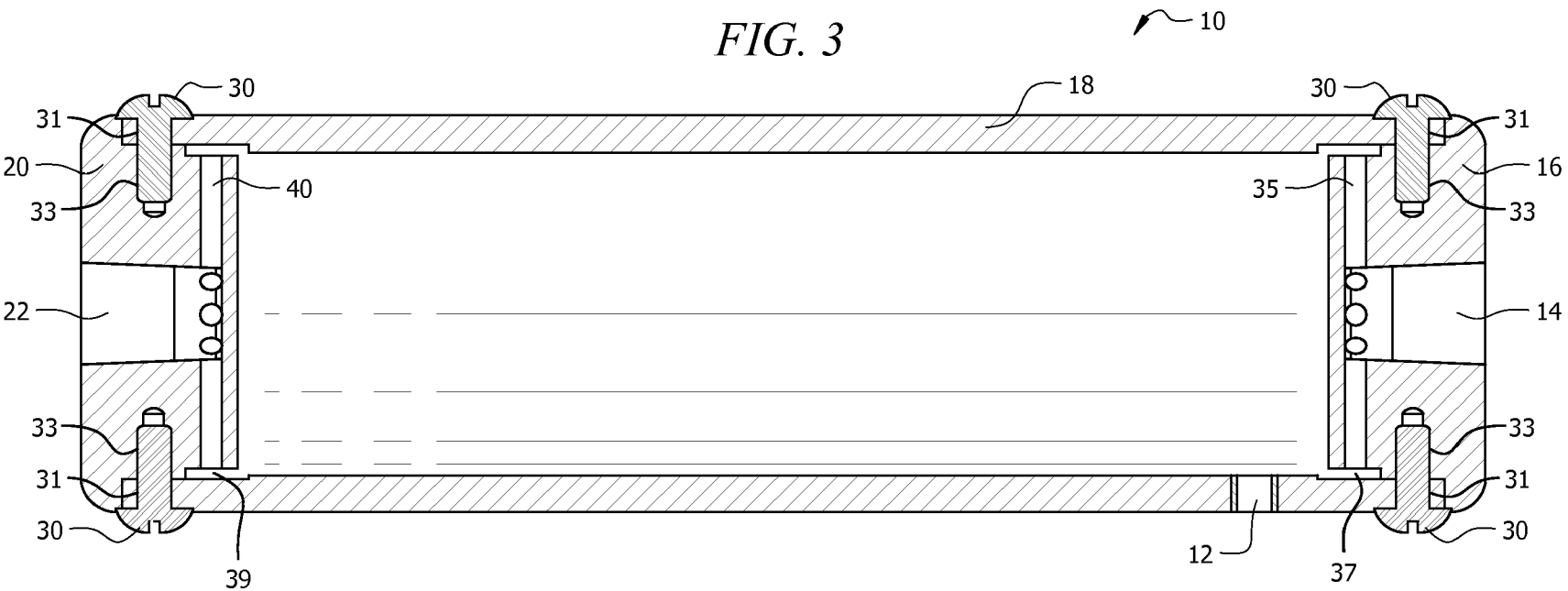
FIG. 3 illustrates a cross-sectional view of the present invention.

Referring to FIG. 3, a cross-sectional view of the present invention is shown. The main cylinder 18 is preferably a cylinder. The main cylinder 18 has a chemical input port 14 for accepting liquid chemicals into the main cylinder 18, for mixing with water. In general, the input port 16 and output port 20 are symmetrical, though this is not a requirement. Water flow enters the turbulator mixing chamber 10 through the input connection interface 14 of the input port 16. Within the input port 16, the water is directed through channels 35 to an outer circumference of the input port 16, where the input port 16 resides within the main cylinder 18. As will be seen, there is a clearance between the outer circumference of the input port 16 and the inner circumference of the main cylinder 18 in which the water flows from the input port 16 into the main cylinder 18, thereby causing turbulence and eddies. In some embodiments, the main cylinder 18 is affixed to the input port 16 by screws 30 passing through holes 31 in the main cylinder 18 and into holes 33 in the input port 16.

Chemicals are pumped into the main cylinder 18 through an orifice 12. The orifice is situated at a location on the wall of the main cylinder 18, preferable near the input port 16 or at a location on the wall of the main cylinder 18, preferably between the mid-point of the main cylinder 18 and the input port 16.

Water exiting the turbulator mixing chamber 10 passes through the output port 20 (similar to the input port 16). Within the output port 20, the water is directed over the outer circumference of the output port 20 and into channels 40. The channels 40 culminate in the output orifice 22 for delivery outside of the turbulator mixing chamber 10. There is a clearance between the outer circumference of the output port 20 and the inner circumference of the main cylinder 18 in which the water flows from the main cylinder 18 through the output port channels 40 to the output port 20 output interface 22, thereby further creating turbulence and eddies. In some embodiments, the main cylinder 18 is affixed to the output port 20 by screws 30 passing through holes 31 in the main cylinder 18 and into holes 33 in the output port 20.

Figure 4:
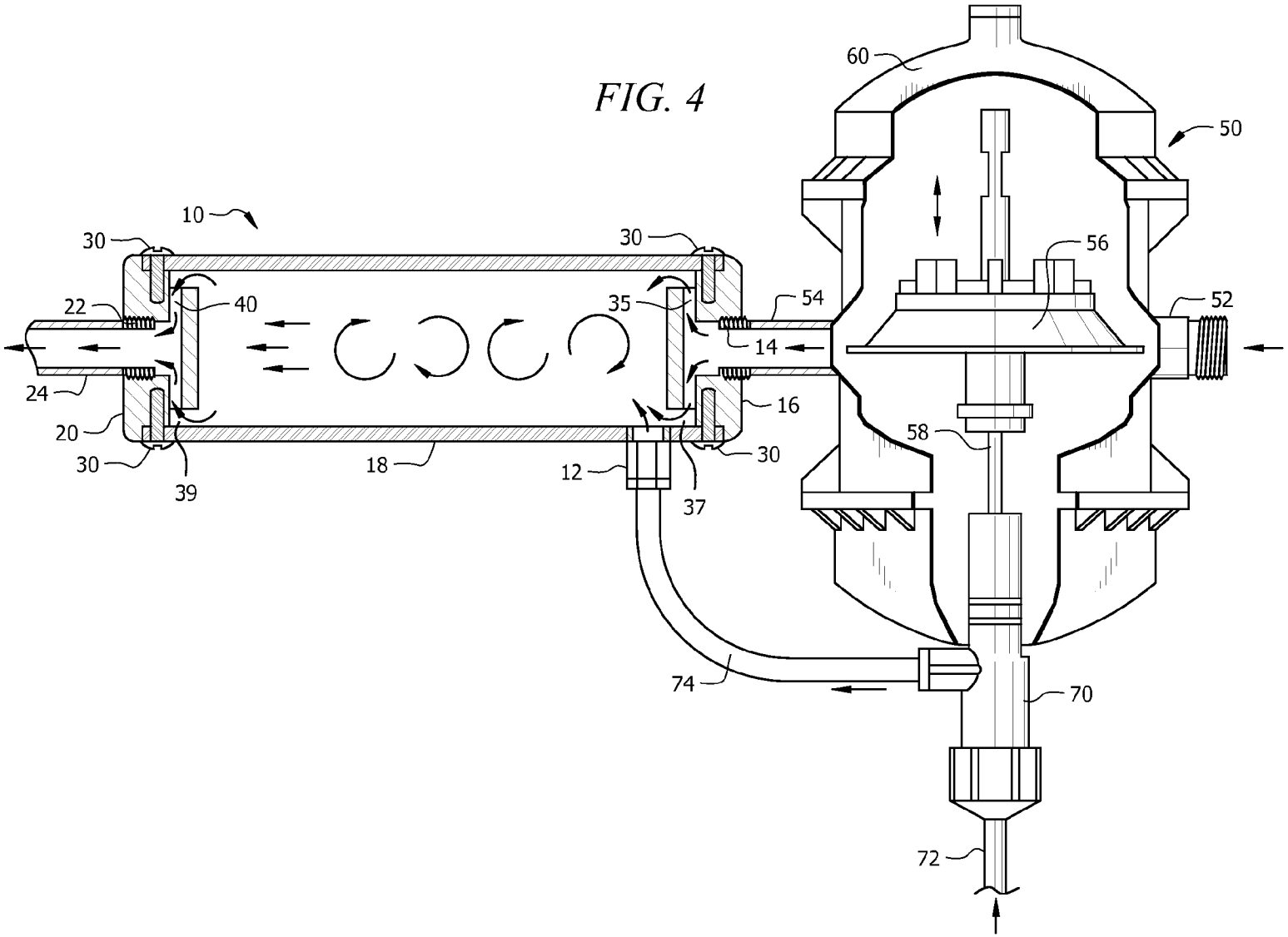
FIG. 4 illustrates a cross-sectional view of the present invention in operation.

Referring to FIG. 4, a cross-sectional view of the present invention in operation is shown. Water enters the water motor 50 through an inlet pipe 52 and using a diaphram 56, the water motor 50 invokes a reciprocal motion of a shaft 58. The shaft 58 is coupled to a pump 70 and the pump is fed with a supply of the lawn chemicals from an input line 72. Water exits the water motor 50 through, for example, a pipe 54. The turbulator mixing chamber 10 input connection 14 connects to the flow of water from the pipe 54 and directs the water flow though the channels 35 in the input port 16. The water flows through a clearance 37 between the inner wall of the main cylinder 18 and the outer circumference of the input port 16 thereby creating a turbulent flow of water through the main cylinder 18. The clearance 37 is any clearance that will provide maximum turbulence and does not necessarily comply with the example shown; a narrower clearance is preferred.

The lawn chemicals from the pump 70 are directed through a feed tube 74 through an orifice 12 and into the main cylinder 18, preferably near the input port 16. The water and chemicals mix thoroughly as they travel down the main cylinder 18 and are forced through the output clearance 39 between the inside surface of the main cylinder 18 and the outer circumference of the output port 20. From there, the mixture exits through the output port 20 channels 40 where they culminate in the output port interface connection 22. From there, the mixture flows through an attached conduit 24 for application to the lawn. The clearance 39 is any clearance that will provide maximum turbulence and does not necessarily match the example shown; a narrower clearance is preferred.

Figure 5:
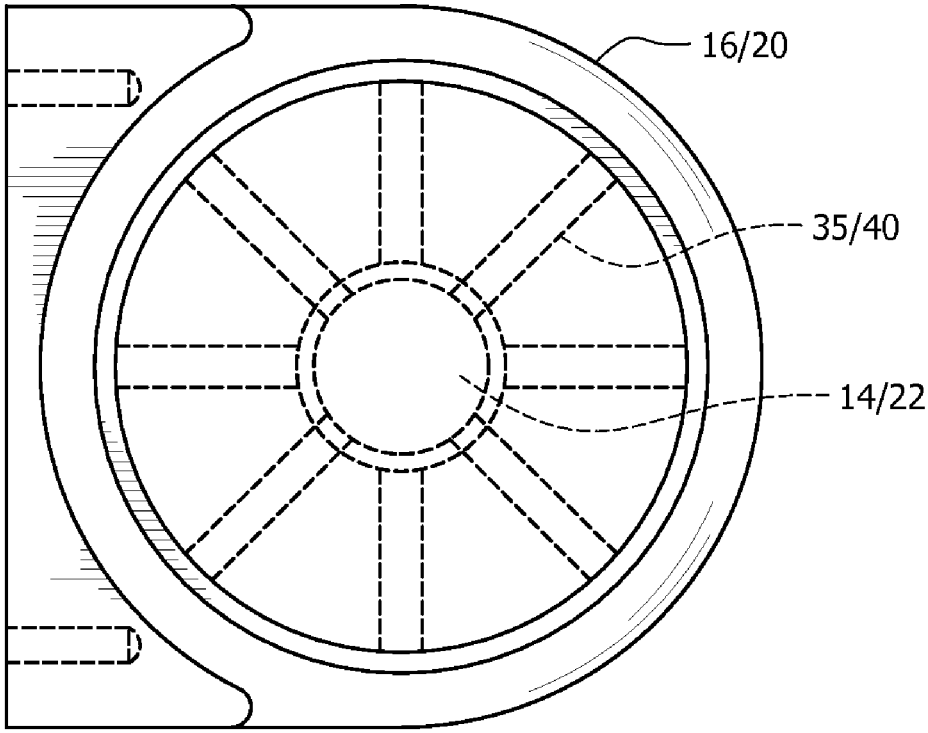
FIG. 5 illustrates a front plan view of an end cap of the present invention.

Referring to FIG. 5, a front plan view of an input and output port of the present invention is shown. For the input port 16, water flows in through the input connection 14, then through the channels 35 and into the main cylinder 18 (not shown in this figure). For the output port 20, the mixture flows through the channels 40, culminating in the output connection 22.

Figure 6:
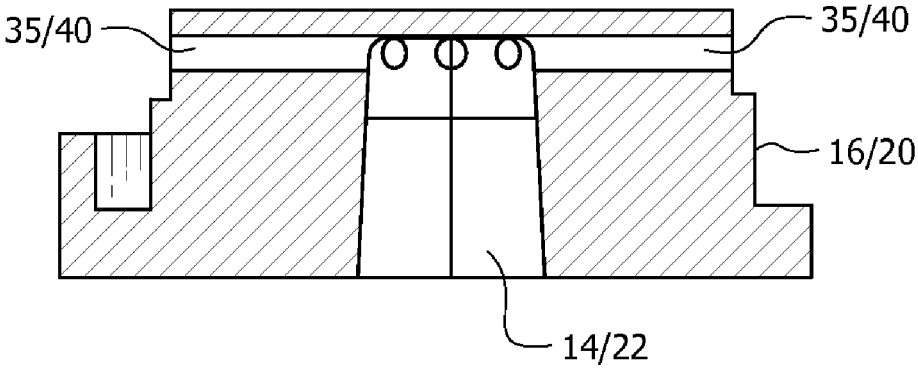
FIG. 6 illustrates a side cross-sectional view of an end cap of the present invention.

Referring to FIG. 6, a side cross-sectional view of an end cap of the present invention is shown. For the input port 16, water flows in through the input connection 14, then through the channels 35 and into the main cylinder 18 (not shown in this figure). For the output port 20, the mixture flows through the channels 40, culminating in the output connection 22. Although any number of channels is anticipated, six to ten channels are sufficient. Although the channels are shown interfacing with the input connection 14 and output connection 22 at right angles, other angles are anticipated for providing various levels of turbulence and there is no limitation that all input channels 35 and/or output channels 40 are situated at the same angle, thereby allowing for a variation in the angle and trajectory of the liquid flow. In some embodiments, the channels 35/40 are curved toward the main cylinder 18.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device for mixing chemicals into a flow of a liquid, the device comprising:

a mixing chamber;

an input port at a first end of the mixing chamber, the input port comprising an input connection for accepting a flow of the liquid; the input port also comprising a plurality of input port channels, the input port channels adapted to direct the flow of the liquid from the input connection to the mixing chamber, the flow directed at an angle with respect to an inner wall of the mixing chamber;

a chemical input orifice for accepting a chemical into the mixing chamber, the chemical input orifice located close to the input port; and an output port at a distal end of the mixing chamber, the output port comprising an output connection for discharging a mixture of the liquid and the chemical; the output port also comprising a plurality of output port channels, the output port channels adapted to direct a flow of the mixture angularly with respect to the inner wall of the mixing chamber to the output connection.

2. The device for mixing chemicals into the flow of the liquid of claim 1, wherein the angle is 90 degrees.

3. The device for mixing chemicals into the flow of the liquid of claim 1, wherein the output port channels direct the flow of the mixture at right angles with respect to the inner wall of the mixing chamber.

4. The device for mixing chemicals into the flow of the liquid of claim 1, wherein the number of input port channels is 8.

5. The device for mixing chemicals into the flow of the liquid of claim 1, wherein the number of output port channels is 8.

6. The device for mixing chemicals into the flow of the liquid of claim 1, wherein the mixing chamber is cylindrical in shape.

7. A method of mixing chemicals into a flow of a liquid, the device comprising:

providing a turbulator mixing device comprising:

a mixing chamber;

an input port at a first end of the mixing chamber, the input port comprising an input connection for accepting the flow of the liquid and the input port also comprising a plurality of input port channels, the input port channels adapted to direct the flow of the liquid from the input connection to the mixing chamber at an angle with respect to an inner wall of the mixing chamber;

a chemical input orifice for accepting a chemical into the mixing chamber, the chemical input orifice located close to the input port; and an output port at a distal end of the mixing chamber, the output port comprising an output connection for discharging a mixture of the liquid and the chemical; the output port also comprising a plurality of output port channels, the output port channels adapted to direct the flow of the mixture angularly with respect to the inner wall of the mixing chamber and out the output connection;

providing a flow of the liquid into the input port;

providing the chemical into the chemical input orifice;

directing the mixture from the output port onto a target of the application.

8. The method of claim 7, wherein the angle is 90 degrees.

9. The method of claim 7, wherein the output port channels exit the flow of the mixture at right angles with respect to the inner wall of the mixing chamber.

10. The method of claim 7, wherein the number of input port channels is 8.

11. The method of claim 7, wherein the number of output port channels is 8.

12. The method of claim 7, wherein the mixing chamber is cylindrical in shape.

13. A device for mixing chemicals into a flow of a liquid, the device comprising:

a mixing chamber;

a means for accepting the liquid into the mixing chamber, the means for accepting comprising a means for accepting the flow of the liquid; the means for accepting also comprising a means for channeling the liquid into the mixing chamber, the means for channeling adapted to direct the flow of the liquid at an angle with respect to an inner wall of the mixing chamber;

a means for accepting a chemical into the mixing chamber, the means for accepting a chemical into the mixing chamber located close to the means for accepting a liquid into the mixing chamber; and an means for outputting a mixture of the liquid and the chemical from the mixing chamber, the means for outputting situated at a distal end of the mixing chamber, the means for outputting comprising a means for discharging the mixture and the means for outputting also comprising a means for channeling the mixture from the mixing chamber to the means for discharging the mixture, the a means for channeling the mixture adapted to discharge the mixture angularly with respect to the inner wall of the mixing chamber.

14. The device for mixing chemicals into the flow of the liquid of claim 13, wherein the angle is 90 degrees.

15. The device for mixing chemicals into the flow of the liquid of claim 13, wherein the means for channeling the mixture from the mixing chamber exit the flow of the mixture is adapted to exit the mixture at right angles with respect to the inner wall of the mixing chamber.

16. The device for mixing chemicals into the flow of the liquid of claim 13, wherein the means for channeling the liquid into the mixing chamber is a plurality of input channels.

17. The device for mixing chemicals into the flow of the liquid of claim 16, wherein there are 8 input channels.

18. The device for mixing chemicals into the flow of the liquid of claim 13, wherein the means for channeling the mixture from the mixing chamber is a plurality of output channels.

19. The device for mixing chemicals into the flow of the liquid of claim 18, wherein there are 8 output channels.

20. The device for mixing chemicals into the flow of the liquid of claim 13, wherein the mixing chamber is cylindrical in shape.

* * * * *